US005186245A

United States Patent [19]

Peters

[11] Patent Number: 5,186,245

[45] Date of Patent: Feb. 16, 1993

[54] FLOW CONTROL BAFFLE FOR RADIATOR IN-TANK COOLER

[75] Inventor: Timothy J. Peters, Lockport, N.Y.

[73] Assignee: General Motors Corporation, Detroit, Mich.

[21] Appl. No.: 864,274

[22] Filed: Apr. 6, 1992

[51] Int. Cl.[5] ..... F28F 9/26; F28F 9/22

[52] U.S. Cl. ..... 165/140; 165/51; 165/916

[58] Field of Search ..... 165/140, 51, 916, 174; 184/104.1, 104.3

[56] References Cited

U.S. PATENT DOCUMENTS

| | | | |
|---|---|---|---|
| 789,079 | 5/1905 | Brandenburg et al. . | |
| 1,925,805 | 9/1933 | Holle . | |
| 2,008,164 | 7/1935 | Wolf | 165/140 |
| 2,014,028 | 9/1935 | Palmer | 165/51 |
| 2,242,432 | 7/1938 | Lukacs . | |
| 2,362,985 | 12/1941 | Brown, Jr. . | |
| 2,730,083 | 7/1953 | Kremser | 123/41.33 |
| 3,831,671 | 8/1974 | Was | 165/154 |
| 4,004,634 | 1/1977 | Habdas | 165/155 |
| 4,086,959 | 5/1978 | Habdas | 165/155 |
| 4,227,570 | 10/1980 | Crews | 165/140 |
| 4,373,578 | 4/1981 | Saperstein et al. | 165/141 |
| 4,553,586 | 11/1985 | Lardner | 165/916 |
| 4,768,580 | 9/1988 | Ferguson | 165/41 |
| 4,834,171 | 5/1989 | Larrabee et al. | 165/140 |
| 5,067,561 | 11/1991 | Joshi et al. | 165/916 |

FOREIGN PATENT DOCUMENTS

| | | | |
|---|---|---|---|
| 0290340 | 11/1988 | European Pat. Off. | 165/916 |
| 557762 | 8/1932 | Fed. Rep. of Germany | 165/140 |
| 3303500 | 8/1983 | Fed. Rep. of Germany | 165/916 |
| 1508082 | 9/1989 | U.S.S.R. | 165/140 |

*Primary Examiner*—John K. Ford
*Attorney, Agent, or Firm*—Ronald L. Phillips

[57] ABSTRACT

An automotive radiator has a tank containing a transmission oil cooler which has a double walled tubular configuration for heat transfer from oil circulating between the walls to the engine coolant through its outer wall and its inner wall. Engine coolant flows from radiator heat exchange tubes into the tank and around and through the cooler to a discharge port. To optimize the efficiency of the cooler, a baffle is inserted in the tank to direct most of the coolant flow in the tank through the oil cooler for heat transfer from the inner wall.

1 Claim, 1 Drawing Sheet

FLOW CONTROL BAFFLE FOR RADIATOR IN-TANK COOLER

FIELD OF THE INVENTION

This invention relates to flow control in heat exchangers and particularly to a baffle arrangement to direct flow through an auxiliary heat exchanger in the tank of a main heat exchanger.

BACKGROUND OF THE INVENTION

In automotive vehicles having automatic transmissions it is common practice to provide a heat exchanger for transmission oil to regulate the internal temperature of the transmission. Often the heat exchanger, called an oil cooler, is combined with the vehicle radiator which cools the vehicle engine by transferring heat from the engine coolant to the ambient air. Such radiators comprise an array of heat exchange tubes arranged in parallel between two headers which hold the tubes in place, and a tank secured to each header to provide respective inlet and outlet reservoirs. Hot coolant from the engine is circulated to the inlet tank, through the heat exchange tubes to the outlet tank, and the cooler coolant is then returned to the engine. Cooling of the transmission oil is accomplished by placing the oil cooler in the outlet tank for heat transfer to the coolant.

One type of oil cooler is a double walled tube immersed in the engine coolant so that the coolant will flow along the outside and inside surfaces for heat transfer from hot oil which is circulated between the tube walls. Typically, the cooler is mounted in the outlet tank so that coolant flows from the heat exchange tubes onto the outer surface of the cooler and some of the coolant passes through the center passage of the cooler and the rest flows directly to the tank outlet, bypassing the center passage of the cooler. To obtain adequate oil cooling for a given size of tank and oil cooler, it is desirable to optimize the heat transfer efficiency of an oil cooler in a radiator tank. It has been found that efficiency of the oil cooler can be enhanced by improving the coolant flow in the tank.

SUMMARY OF THE INVENTION

It is therefore an object of the invention to provide enhanced cooling of an auxiliary heat exchanger within a main heat exchanger, and particularly to optimize efficiency of an oil cooler in a radiator tank by providing improved coolant flow about the cooler.

The invention is carried out by a heat exchanger having a tank at one end and an auxiliary heat exchanger in the tank comprising: an elongated tank having inlet and outlet ports including an elongated port at one side; a main heat exchanger secured to one side of the tank and having a plurality of coolant flow channels coupled to the elongated port; an auxiliary heat exchanger disposed within the tank and having a tubular configuration for internal and external thermal contact with coolant flow between the inlet and the outlet ports; and baffle means in the tank between the auxiliary heat exchanger and the outlet port and adjacent an end of the auxiliary heat exchanger for maximizing coolant flow from the inlet to the outlet port through the auxiliary heat exchanger.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
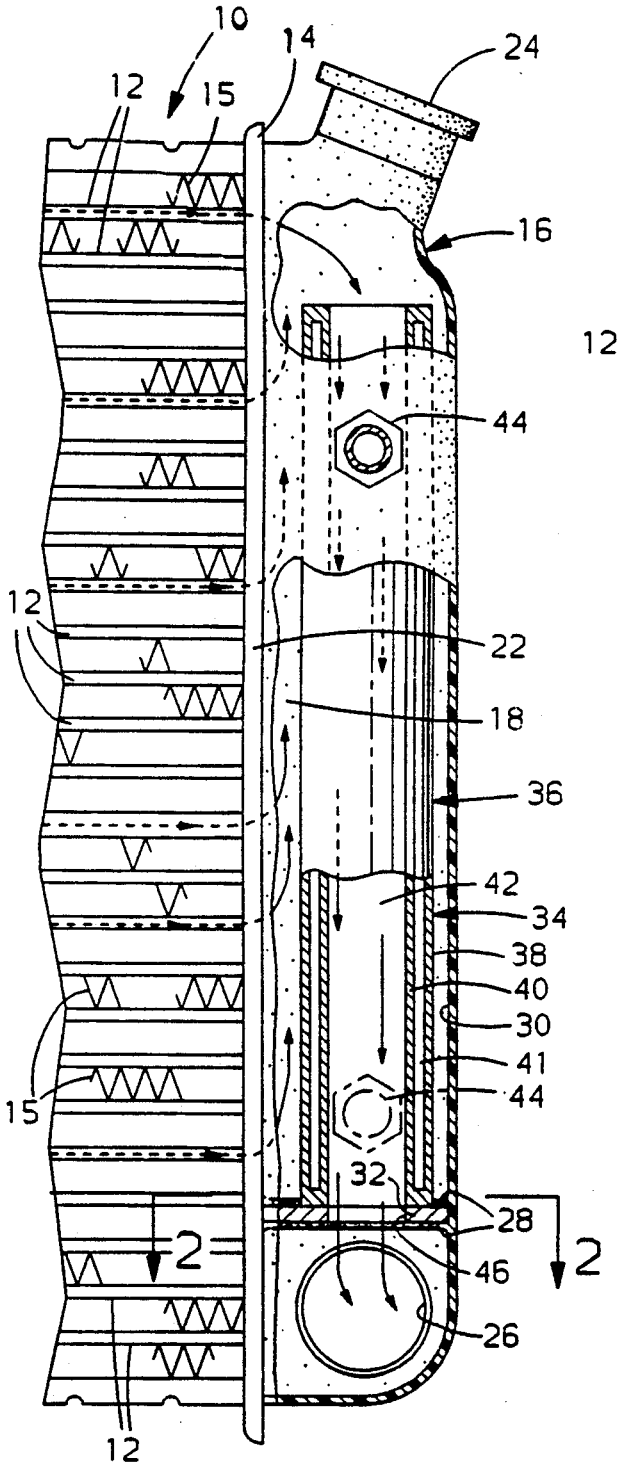
FIG. 1 is a partially sectioned elevation of an end portion of an automotive radiator and oil cooler, according to the invention.
Figure 2:
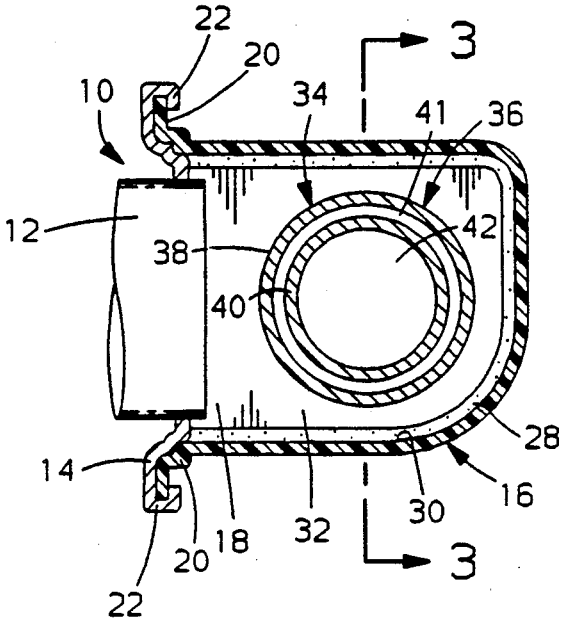
FIG. 2 is a cross-sectional view of the tank and cooler taken along line 2—2 of FIG. 1.
Figure 3:
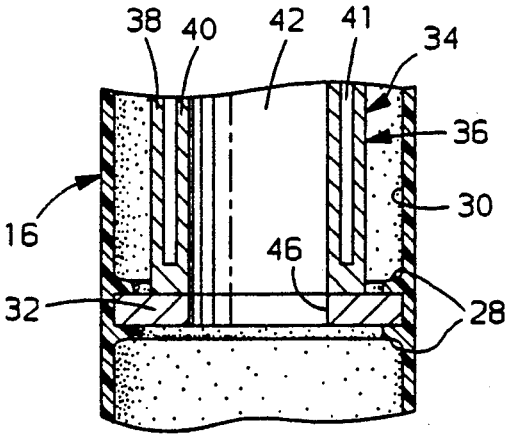
FIG. 3 is a cross-sectional view of the tank and cooler taken along line 3—3 of FIG. 2.

The ensuing description is directed to a main heat exchanger or radiator containing in its tank an auxiliary heat exchanger or oil cooler, and a baffle arrangement in the tank for improving the efficiency of the auxiliary heat exchanger by channeling more of the coolant flow through the auxiliary unit. It will be apparent that the invention can be applied to systems other than a radiator and oil cooler.

Referring to all the drawings, an automotive radiator 10 of the cross-flow type has a horizontal array of parallel flat heat exchange tubes 12 which are brazed to an apertured header 14 which supports the tubes. The tubes 12 and header 14 are of aluminum or other heat conductive metal to facilitate heat transfer from coolant in the tubes to air flowing outside the tubes. Corrugated air centers or fins 15 between the tubes assist in the heat transfer. The tubes 12 together with the corrugated air centers or fins 15 constitute a conventional heat exchanger core. A tank 16 of polymeric material has an open side defining an elongated inlet port 18 and which terminates in outwardly turned flange 20 An outer flange 22 of the header is crimped over the flange 20 to form a leak-proof joint. Thus the tank 16 and the header 14 together comprise a reservoir. A similar reservoir, not shown, is attached to the other side of the radiator.

The tank 16 has an upper filler neck 24 and a lower outlet port 26 extending laterally from the tank 16 near the bottom. Just above the outlet port 26, a pair of vertically spaced ribs 28 are molded into the inner wall 30 and extend completely around the tank to the inlet port 18 on either side. A plate-like baffle 32 is contained between the ribs 28, being slidably assembled to the tank prior to its assembly to the header 14. After assembly, the header abuts an edge of the baffle 32 to secure the baffle in position. As indicated in FIG. 1, the baffle is so situated that it is above a very few of the tubes 12 such that only those few tubes will discharge coolant directly to the region of the outlet port 26. The vast majority of the tubes 12 discharge coolant at locations above the baffle 32.

An oil cooler 34 in the tank 16 comprises a double-walled tube 36 having an outer wall 38 and an inner wall 40 of heat conductive metal defining an annular space 41 and a central tube passage 42. Upper and lower fittings 44 extend laterally outwardly of the tube 36 and through the wall of the tank 16. Transmission oil flows into the cooler through one fitting 44 and out through the other, and the oil is circulated through the annular space 41 between the tube 36 walls. Heat is transferred from the oil through both the inner wall 40 and the outer wall 38 to the engine coolant. The lower end of the oil cooler 34 is adjacent and preferably in contact with the baffle 32 which has an opening 46 coincident with the central passage 42 of the cooler.

The presence of the baffle forces coolant flow from all the tubes 12 above the baffle to flow upwardly along the outer wall 38 of the cooler 34 and down through the central passage 42 to the outlet port 26 thereby absorbing heat from both walls 38 and 40 of the cooler 34. It is already known to use similar heat exchange systems but without the baffle 32. In the latter case, most of the coolant emitted from the tubes 12 will flow down past the cooler outer wall 38 to the outlet port 26, thereby bypassing the central passage 42 of the oil cooler 34. The presence of the baffle increases the heat transfer of the oil cooler by about 20% according to preliminary tests. This significant improvement is achieved without increasing the size of the cooler 34 or of the tank 16, and the cost of the improvement is small.

The embodiments of the invention in which an exclusive property or privilege is claimed are defined as follows:

1. A heat exchanger, comprising:

an elongated reservoir on one side of a heat exchanger core having a top and a bottom with a coolant outlet port at the bottom of said reservoir, means forming a plurality of parallel tube passes all of which inlet coolant to said reservoir along the length of said reservoir, an auxiliary tubular heat exchanger within said reservoir having an upper end near the top of said reservoir and a lower end located just above said outlet port, said tubular heat exchanger having an inner wall defining a central passage and an outer wall spaced from said inner wall and said reservoir and inlet and outlet means for fluid to flow between said walls, and, only one baffle in said elongated reservoir located at the lower end of said tubular heat exchanger, above said reservoir outlet port and below substantially all of said tube passes, said baffle filling the space between said tubular heat exchanger outer wall and reservoir and having an aperture registered with said central passage, whereby coolant entering said reservoir from substantially all of said tube passes is forced to flow upwardly along said outer wall toward the top of said reservoir and down through said central passage baffle aperture before reaching said outlet port, thereby improving heat transfer from said tubular heat exchanger to said coolant.

* * * * *